US008311440B2

(12) United States Patent
Tidrick

(10) Patent No.: US 8,311,440 B2
(45) Date of Patent: Nov. 13, 2012

(54) LASER SCANNER WINDOW CLEANER

(75) Inventor: Robert C Tidrick, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 307 days.

(21) Appl. No.: 12/782,776

(22) Filed: May 19, 2010

(65) Prior Publication Data

US 2011/0286760 A1 Nov. 24, 2011

(51) Int. Cl.

| | |
|---|---|
| ***G03G 21/00*** | (2006.01) |
| ***G03G 21/16*** | (2006.01) |
| ***G03G 15/00*** | (2006.01) |
| ***G03G 15/04*** | (2006.01) |
| ***G03G 15/20*** | (2006.01) |

(52) U.S. Cl. ..... 399/99; 399/111; 399/118; 399/119; 399/123

(58) Field of Classification Search ..... 399/98, 399/99, 100, 111, 118, 119, 123
See application file for complete search history.

(56) References Cited

U.S. PATENT DOCUMENTS

| | | | | |
|---|---|---|---|---|
| 5,689,769 | A | 11/1997 | Appel et al. | |
| 2008/0205951 | A1 * | 8/2008 | Ueda et al. | 399/345 |
| 2008/0286001 | A1 * | 11/2008 | Matsumoto et al. | 399/112 |

* cited by examiner

*Primary Examiner* — Joseph S Wong

(57) ABSTRACT

A cleaning pad that is part of a printer developer customer replaceable unit cleans a laser aperture each time the customer replacement unit is removed and/or replaced. The pad is located on an inboard end of the customer replaceable unit such that when inserted into the printer it wipes any accumulated toner from the surface of the laser aperture. Also, in developer units that include a light proof cover that retracts at the time of insertion, the wiper is situated so that it cleans the aperture in the process of retracting.

20 Claims, 1 Drawing Sheet

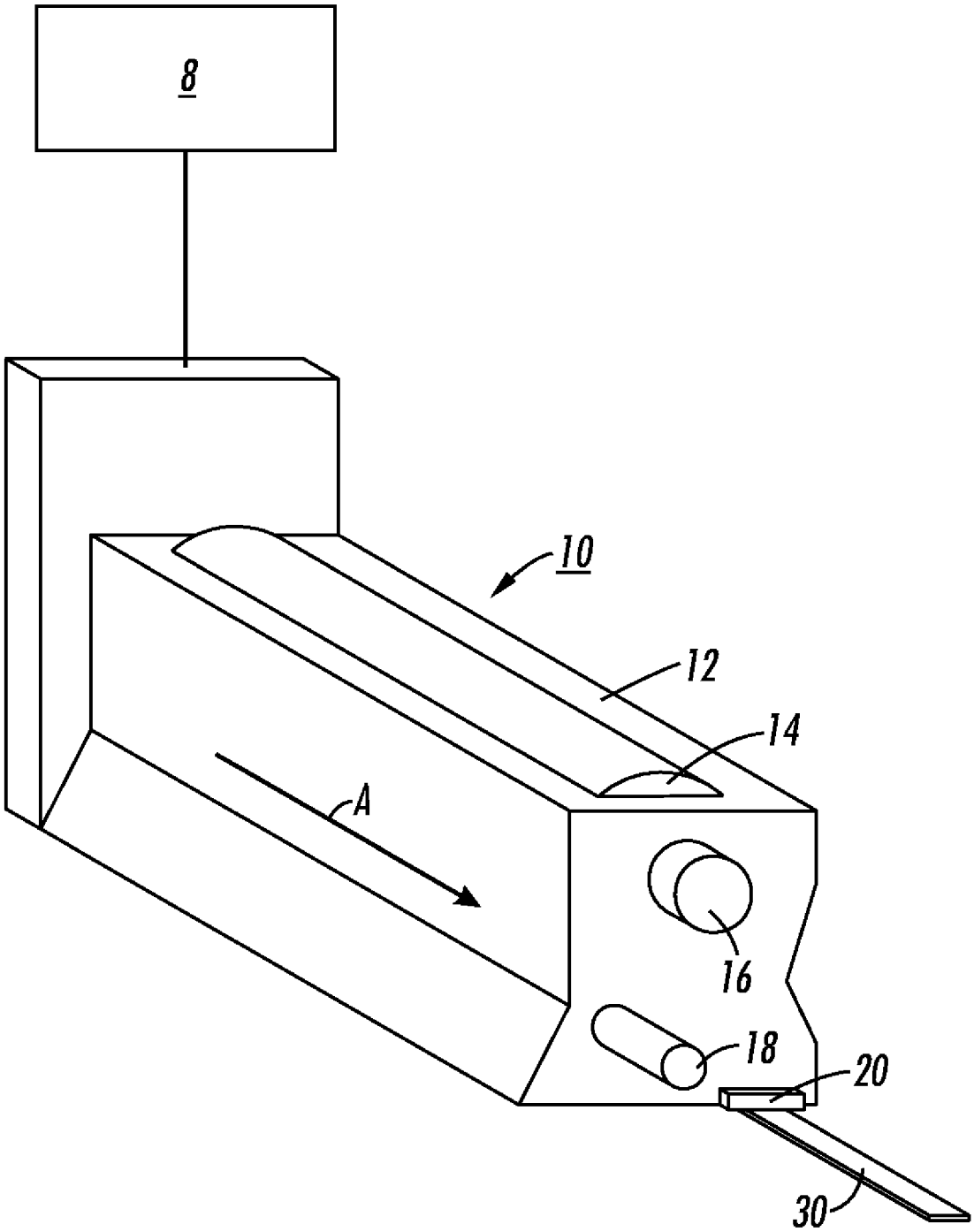
8
10
12
14
A
16
18
20
30

LASER SCANNER WINDOW CLEANER

BACKGROUND

1. Field of the Disclosure

The present disclosure relates to xerographic printers, and specifically to a mechanism which ensures that an exit window of a raster output scanner is simultaneously cleaned as a developer customer replacement unit of a printing apparatus is replaced.

2. Description of Related Art

Typically, in the process of electrostatographic or xerographic printing, an electrostatic latent image is formed on a charge-retentive surface, and then developed with an application of toner particles. The toner particles adhere electrostatically to the suitably-charged portions of the imaging surface. The toner particles are then transferred, by the application of electric charge, to a print sheet, forming the desired image on the print sheet. An electric charge can also be used to separate or "detack" the print sheet from the imaging surface. For machines using an electrostatic brush cleaner, a preclean electric charge is used to adjust the charge on toner particles entering the electrically biased cleaning brush. In some multiple color machines, e.g., a single pass image-on-image system, electric charge is used to recharge the toner and photoreceptor from the previous development step prior to development of the next color. In tandem multiple color machines using development to an intermediate surface, electric charge is used for first transfer from each photoreceptor to the intermediate and for second transfer from the intermediate to paper. One such printer is shown in U.S. Pat. No. 5,689,769 and it and the references cited therein are incorporated herein by reference to the extent necessary to practice the present disclosure.

In printing machines such as the one described above, a CRU is a customer replacement unit which can be replaced by a customer at the end of life or at the premature failure of one or more of the xerographic components. The CRU concept integrates various subsystems whose useful lives are predetermined to be generally the same length. The service replacement interval of the CRU ensures maximum reliability and greatly minimizes unscheduled maintenance service calls. Utilization of such a strategy, allows customers to participate in the maintenance and service of their copier/printers. CRUs ensure maximum up time of copier/printers and minimize down time and service cost due to end of life or premature failures.

It is important that customer replacement units be customer friendly. That is, it is important that the CRUs may be easily removed and reinstalled with minimal instructions and minimal training. Unfortunately, the CRUs typically include a number of items that are critical to the proper operation of the machine, e.g., charging devices, photoreceptors and toner cleaner subsystems and other subsystems. The components and subsystems are very delicate and need to be properly handled and not damaged during the installation and removal of the CRUs.

Among many types of light exposure systems in printers is the commonly used raster output scanner (ROS). A raster output scanner is comprised of a laser beam source, a modulator for modulating the laser beam (which, as in the case of a laser diode, may be the source itself), such that the laser beam contains information that is to be created, a rotating polygon having at least one reflective surface, input optics that collimate the laser beam, output optics which focus the laser beam into a spot on a photoreceptor's surface and which corrects for various optical problems, such as, wobble and usually one or more folding mirrors. The laser source, modulator, and input optics produce a collimated laser beam which is directed toward the polygon. As the polygon rotates, the reflective surface(s) causes the laser beam to be swept along a scan plane. The swept laser beam passes though the output optics and is reflected by the mirror(s) so as to produce a sweeping spot on the charged photoreceptor and which traces a scan line across the photoreceptor. Since the charged photoreceptor moves in a direction which is substantially perpendicular to the scan line, the sweeping spot raster scans the photoreceptor. By suitably modulating the laser beam as the spot raster scans the photoreceptor a desired latent image can be produced on the photoreceptor.

The ROS is usually enclosed in a compartment to protect it from contaminants. In that case, the enclosed compartment has an exit window, a glass window disposed between the ROS and the photoreceptor, through which the laser beam can pass. While the inclusion of an exit window reduces contamination of the ROS itself, the mobile natures of the contamination combined with the turbulent air flow around a moving photoreceptor, means that if left alone the exit window aperture will eventually become coated with contaminants.

In the prior art, to prevent the exit window from being excessively contaminated, field service personnel were instructed to clean the exit window at every service call. This was not thoroughly satisfactory since the service provider could fail to clean the exit window, or if the machine does not require frequent service, excessive contamination could result. While a fully automated exit window cleaner could be implemented, its cost would be excessive, especially, in low cost machines.

Additionally, state of the art laser image developers consist of an expendable developer cartridge that contaminates the aperture when it slides in and out of a laser printer when the need arises for it be replaced or otherwise serviced. During the time in which the unit is in service in the printer, waste toner is removed via a mechanical connection within the body of the printer. Waste toner may also accumulate around the surfaces of the cartridge during use. Toner may also accumulate on the surfaces around the cartridge due to leakage or normal migration of toner particles. One of these surfaces is the aperture through which the laser beam, which writes the image, travels to the photosensitive drum. This surface typically is a plate of optical quality glass. In many cases, this plate lies beneath the developer cartridge and lies in a horizontal orientation. It is known in the art that toner may accumulate on this aperture and appropriate measures are taken to provide for cleaning. This method is typically a wand with a cleaning pad attached to one end that can be inserted into the space between the developer and the aperture. This is done when image quality problems are noticed that may corrected by this procedure. Two problems arise that must be addressed at times using this method.

First is the slow accumulation of toner on the aperture that may go unnoticed and simply degrade the image quality over time. The customer may not notice the degradation over time and unknowingly accept lower than optimum print quality. Secondly is the obvious problem of toner dropping from the developer unit when it is removed and/or replaced and causing noticeable image quality problems that may or may not be recognized as being caused by toner on the aperture. These problems can mistakenly be blamed on the quality of the imaging unit and have resulted in calls to a service center.

Hence, the need still exists for a low cost ROS exit window cleaner.

SUMMARY

Accordingly, an answer to the above-mentioned problems is disclosed which includes a cleaning pad that is part of a printer developer customer replacement unit that will clean a laser aperture each time it is removed and/or replaced. The pad is so located on the inside end of the developer customer replacement unit that when inserted into the printer it wipes any accumulated toner from the surface of the laser aperture. Also, in developer units that include a light proof cover that retracts at the time of insertion, the wiper is situated so that it cleans the aperture in the process of retracting.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

The FIGURE includes a perspective view showing a developer unit that includes an attached laser aperture cleaning pad.

DETAILED DESCRIPTION OF THE PREFERRED EMBODIMENT

As shown in The FIGURE, and in accordance with the present disclosure, a dual purpose developer CRU or cartridge 10 includes a housing 12 that supports developer therein and a developer roll 14 that contacts the developer and removes it from the housing 12 for placement onto a photosensitive surface of a conventional printer represented by box 8 (for example, as shown in U.S. Pat. No. 5,689,769) for development of an image thereon. The developer roll 14 is supported for rotation within housing 12 on a rotatable shaft 16 while housing 12 is mounted within the printer by use of support member 18. A cleaning pad 20 made of soft and flexible material is attached to the developer CRU 10 on the leading edge of its insertion end (which is in the direction of arrow A) so that cleaning pad 20 contacts laser aperture 30 when inserted into the printer body. This creates a wiping action that will allow for the aperture 30 to be cleaned each time the CRU is moved into or out of the body of the printer. Thus, optimum image quality is attained after replacement of the cartridge, as well as, possible prevention of calls to a service center regarding streaks or other print quality problems.

In recapitulation, a wiper is added to a developer cartridge to clean the laser aperture within a printer each time the cartridge is removed and preplaced. The wiper or pad is located on the inboard end of the cartridge. When the cartridge is inserted into the printer it wipes any accumulated toner from the surface of the laser aperture. Thereby eliminating the need for a detached wiper wand and wiping process that is needed presently to keep a printer functioning well.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device, comprising:

an apparatus that receives an image signal representing an image to be printed;

a charge retentive surface;

a charging station that charges the charge retentive surface to a relatively high potential;

an exposure station that receives images signals from said apparatus and records an electrostatic latent image on said charge retentive surface, said exposure station including a raster output scanner with a light exit aperture;

a development station including a developer customer replacement unit that deposits developer over the electrostatic latent image on said charge retentive surface to form a developed image;

a transfer station that transfers the developed image from said charge retentive surface to a recording media; and a cleaning member that is a part of and fixedly attached against independent movement to said developer customer replacement unit and adapted to be moved only when said developer customer replacement unit is moved and positioned to be in continual contact with said light exit aperture such that insertion of said developer customer replacement unit into said reprographic device cleans said light exit aperture a first time and removal of said developer customer replacement unit from said reprographic device cleans said light exit aperture of said raster output scanner a second time.

2. The reprographic device of claim 1, wherein said developer customer replacement unit is adapted for non-rotational movement.

3. The reprographic device of claim 1, wherein said cleaning member includes at least a portion thereof attached to an outside surface of said developer customer replacement unit.

4. The reprographic device of claim 1, wherein said cleaning member is a cleaning pad, and wherein said cleaning pad is located on an inside end of said developer customer replacement unit.

5. The reprographic device of claim 4, wherein said cleaning pad is located on a bottom surface of said inside end of said developer customer replacement unit and integrally attached thereto.

6. The reprographic device of claim 5, wherein said developer customer replacement unit includes a developer roll, and wherein said developer roll is positioned above said cleaning pad.

7. The reprographic device of claim 1, wherein said cleaning member is a cleaning pad, and wherein said cleaning pad includes at least a portion thereof attached to a bottom portion of an outside end surface of said developer customer replacement unit.

8. The reprographic device of claim 6, wherein said cleaning pad is positioned such that insertion and removal of said developer customer replacement unit from said reprographic device causes said cleaning pad to slide over an outer surface of said light exit aperture of said raster output scanner.

9. The reprographic device of claim 8, wherein said light exit aperture of said raster output scanner is a glass plate.

10. A dual purpose developer customer replacement unit, comprising:

a development portion that deposits developer over an electrostatic latent image on a photoconductive surface to form a developed image; and a single piece, stationary cleaning portion integrally attached to said development portion of said developer customer replacement unit that is adapted through continued contact therewith to clean a window of a raster output scanner upon the insertion and removal of said developer customer replacement unit from a reprographic device.

11. A method for cleaning an exit window of a raster output scanner within a printer, comprising:

providing an apparatus that receives an image signal representing an image to be printed;

providing a charge retentive surface;

providing a charging station that charges the charge retentive surface to a relatively high potential;

providing an exposure station that receives images signals from said apparatus and records an electrostatic latent image on the charge retentive surface, said exposure station including a raster output scanner with a light exit aperture;

providing a developer customer replacement unit that deposits developer over the electrostatic latent image on the charge retentive surface at a development station to form a developed image;

providing a transfer station that transfers the developed image from the charge retentive surface to a recording media; and providing a single piece and non-independently movable cleaning member attached to said developer customer replacement unit adapted such that insertion and removal of said developer customer replacement unit from said printer cleans said light exit aperture of said raster output scanner.

12. The method of claim 11, wherein said developer customer replacement unit is adapted for non-rotational movement.

13. The method of claim 12, wherein said cleaning member includes at least a portion thereof attached to an outside surface of said developer customer replacement unit.

14. The method of claim 11, including locating said cleaning member on an inside end of said developer customer replacement unit.

15. The method of claim 11, locating said cleaning member on a bottom surface of said inside end of said developer customer replacement unit.

16. The method of claim 15, wherein said developer customer replacement unit includes a developer roll and wherein said developer roll is positioned above said cleaning member.

17. The method of claim 15, wherein said cleaning member is a pad that includes a soft flexible material.

18. The method of claim 16, wherein said cleaning member is positioned such that insertion and removal of said developer customer replacement unit from said printer causes said cleaning member to slide over an outer surface of said light exit aperture of said raster output scanner and clean the same.

19. The method of claim 18, wherein said light exit aperture of said raster output scanner is a glass plate.

20. The method of claim 11, wherein said developer customer replacement unit includes a housing, and wherein said housing and said cleaning member are integral.

* * * * *